US006837240B1

(12) United States Patent
Olstad et al.

(10) Patent No.: US 6,837,240 B1
(45) **Date of Patent: *Jan. 4, 2005**

(54) DISPLAY SYSTEM UPGRADE FOR A FULL FACE MASK

(75) Inventors: William Olstad, Panama City, FL (US); Dennis Gallagher, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/457,694

(22) Filed: Jun. 9, 2003

(51) Int. Cl.[7] ..... B63C 11/02; G02C 1/00

(52) U.S. Cl. ..... 128/201.27; 128/206.23; 128/206.26; 351/43; 351/158

(58) Field of Search ..... 128/206.28, 207.11, 128/207.12, 207.18, 201.22, 201.23, 201.24, 201.27, 201.29, 201.11, 202.19, 206.12, 206.13, 206.21, 206.23, 206.24, 206.26, 206.67; 2/410, 422, 423, 424, 426, 9, 202, 205; 351/43, 158

(56) References Cited

U.S. PATENT DOCUMENTS 6,447,115 B1 * 9/2002 Gallagher et al. ..... 351/43
6,626,178 B2 * 9/2003 Morgan et al. ..... 128/206.26

* cited by examiner

*Primary Examiner*—Henry Bennett
*Assistant Examiner*—Andrea M. Ragonese
(74) *Attorney, Agent, or Firm*—Donald G. Peck; James T. Shepherd

(57) ABSTRACT

A full face mask has a body frame having a continuous, closed sidewall extending and compliantly resting on bony contours around facial features of a wearer, and a lateral partition extending and resting on bony contours of a wearer's face from one side to another side of the sidewall between the areas of the nose and upper lip. The lateral partition separates the frame into a lower mask section having a lower cavity with a pod opening and an upper mask section having an upper cavity. Lenses supported by the frame define a forward field of view and integrated in the frame are components including a radio frequency antenna receiving dive information signals, a display in a peripheral area outside of the forward field of view, a controller coupled for processing the signals to generate outputs, and a control that passes outputs for display at the visual display.

8 Claims, 3 Drawing Sheets

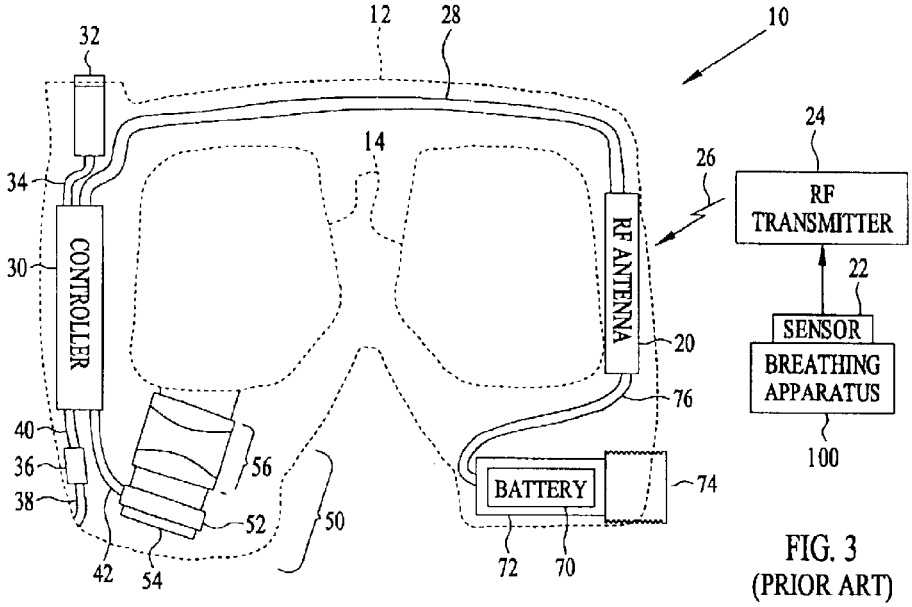
FIG. 3
(PRIOR ART)
FIG. 4
(PRIOR ART)
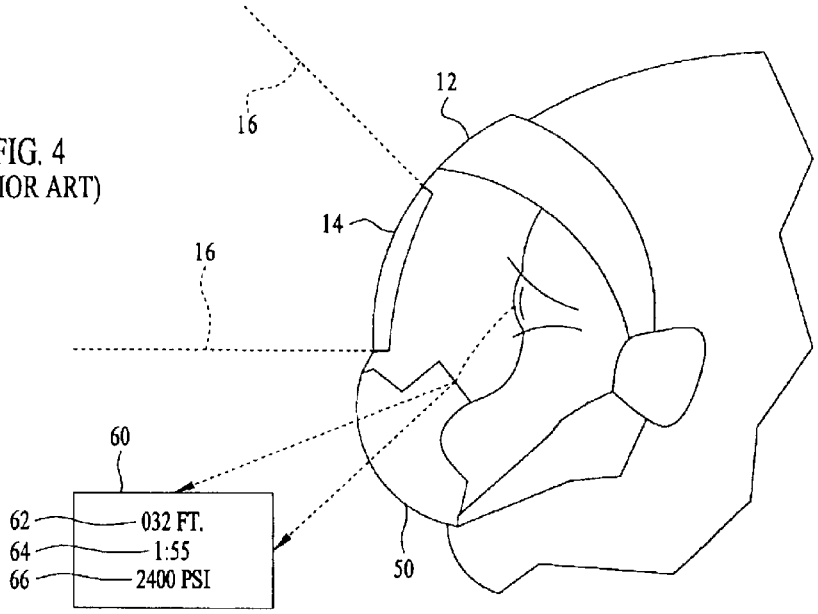

DISPLAY SYSTEM UPGRADE FOR A FULL FACE MASK

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to full face masks for divers. More particularly, this invention is to a display system for a diving full face mask allowing simultaneous monitoring of information from multiple sources in a single location in the lower right corner of the facemask regardless of environmental conditions and physical constraints on the diver without obstructing normal field of view.

A diver's safety is always of paramount consideration as tasks are performed. However, divers (or firefighters and others working in extremely hazardous environments) cannot unduly add encumbrances that might overly compromise their operational effectiveness. A number of acceptable devices and procedures have been developed to improve safety. For obvious reasons, a diver must be able to monitor certain critical information such as the diver's depth, the status of the life-support breathing apparatus, and the total time of the dive under all environmental and operational conditions. Typically, the diver is supplied with separate timers, pressure gauges and/or other displays for monitoring critical information.

These timers/gauges/displays are either wrist-worn devices or are mounted on a console that the diver wears or carries, or are placed on or attached to the diver's face mask. The problem with wrist-worn or console-type devices is that the diver may not be able to see or access the devices because of tasks involving the use of both of the diver's hands (e.g., operating cameras, sonar devices, navigation or other data logging device, etc.). Further, if visibility in the water is poor, the diver may not even be able to see the device. For these reasons, critical dive information should be made available at the diver's facemask.

Other considerations affecting safety and operational effectiveness are directly related to a diver's ability to communicate in real-time with topside personnel or other scuba divers. These communication issues have been addressed in the design disclosed in U.S. Pat. No. 4,029,092 showing a separately sealed lower section that is conducive to mounting of a microphone for electronically transmitted speech or for transmitting speech diaphragmatically through the water to another diver in close proximity. The full face mask (FFM) of '092 also appeals to divers who spend extended periods underwater where there is a need for full facial coverage for warmth, protection and comfort. However, a capability for presenting readable data inside the '092 face mask is not provided for.

Thus, in accordance with this inventive concept, a need has been recognized in the state of the art for an integrated display capability for wearer's of FFMs to improve safety and operational effectiveness without unduly encumbering them.

OBJECTS AND SUMMARY OF THE INVENTION

An object of the invention is to increase the safety and operational effectiveness of a diver wearing a FFM by adding an integrated display capability to an existing FFM design.

Another object of the invention is to enhance proven capabilities of a FFM with proven capabilities of a face mask covering only part of the facial features to provide a further improved FFM having increased safety and operational effectiveness.

Another object is to provide a FFM system that allows a diver having an exhausted source of air or an emergency requiring ditching of the breathing apparatus, to quickly switch over to an alternate breathing system or swim freely without removing an upper portion of the FFM and consequent loss of vision due to the flooding of the viewing area.

These and other objects of the invention will become more readily apparent from the ensuing specification when taken in conjunction with the appended claims.

Accordingly, the present invention is to a full face mask (FFM) system. A main body frame has a continuous, closed sidewall portion extending around and compliantly resting on bony contours around facial features of a diver wearing the FFM. A lateral partition extends along and rests on bony contours of a wearer's face from one side to another side of the sidewall portion between the areas of a wearer's nose and upper lip. The lateral partition separates the main body frame into a lower mask section having a lower cavity and an upper mask section having an upper cavity. The lower mask section has a round, grooved, pod-adapter opening adjacent to the lower cavity, and at least one lens defining a forward field of view is supported by the frame. Components are integrated in the frame that include a radio frequency (RF) antenna for receiving RF signals indicative of dive information, a display directly viewable in a peripheral vision area outside of the forward field of view, a controller coupled to the RF antenna and the display for processing the RF signals in accordance with predetermined programming options to generate outputs, and an input device is coupled to the controller for selecting the predetermined programming options, and passing the outputs to the display for visual display. A compliant sidewall elastomeric sealing flange is connected to and along the continuous, closed sidewall portion and extends and compliantly rests on bony contours around facial features of a wearer of the FFM system. A compliant lateral lip is connected to and along the lateral partition and extends and rests on bony contours of a wearer's face from one side to another side of the sidewall portion between the areas of a wearer's rose and upper lip. The lateral partition and the compliant lateral lip separate the main body frame into the lower mask section having the lower cavity and the upper mask section having the upper cavity. The components integrated in the frame also include a replaceable power source for supplying power to all others of the components, and a depth sensor is coupled to the controller. The controller includes timing means actuated by the input device, and the timing means generates a signal indicative of an amount of time lapsed since its actuation. The indicative signal is displayed visually on the display. The display includes a stacked combination of an optical system for providing even magnification across the display, a liquid crystal display positioned adjacent the optical system for magnification, and a light source for backlighting the liquid crystal display. The liquid crystal display can be either a transmissive or transflective liquid crystal display or other display technologies including, but not limited to electroluminescent displays, and light emitting diode (LED) displays, and the display is located in a lower portion of the peripheral vision area.

BRIEF DESCRIPTION OF THE DRAWINGS

FIG. 3 is a schematic view of a dive mask of the prior art covering only about one-half of a diver's face that integrates a dive monitoring system with the mask's lens and frame shown in phantom to reveal components of the monitoring system.

FIG. 4 is a schematic view of the prior art dive mask showing an apparent image of information by the display components.

DESCRIPTION OF THE PREFERRED EMBODIMENTS

Figure 1:
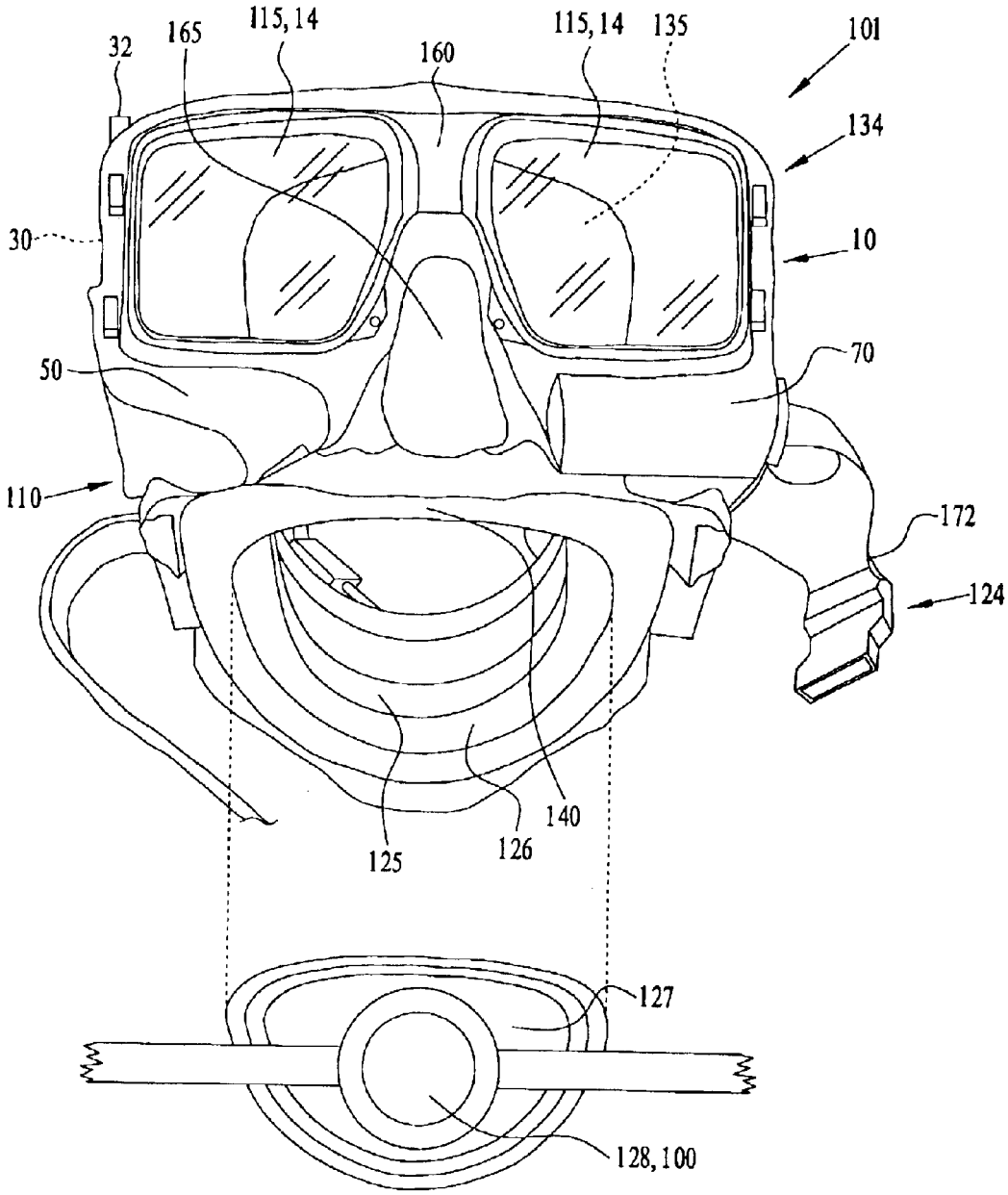
FIG. 1 is a schematic front view of the improved full face mask (FFM) system of the invention.
Figure 2:
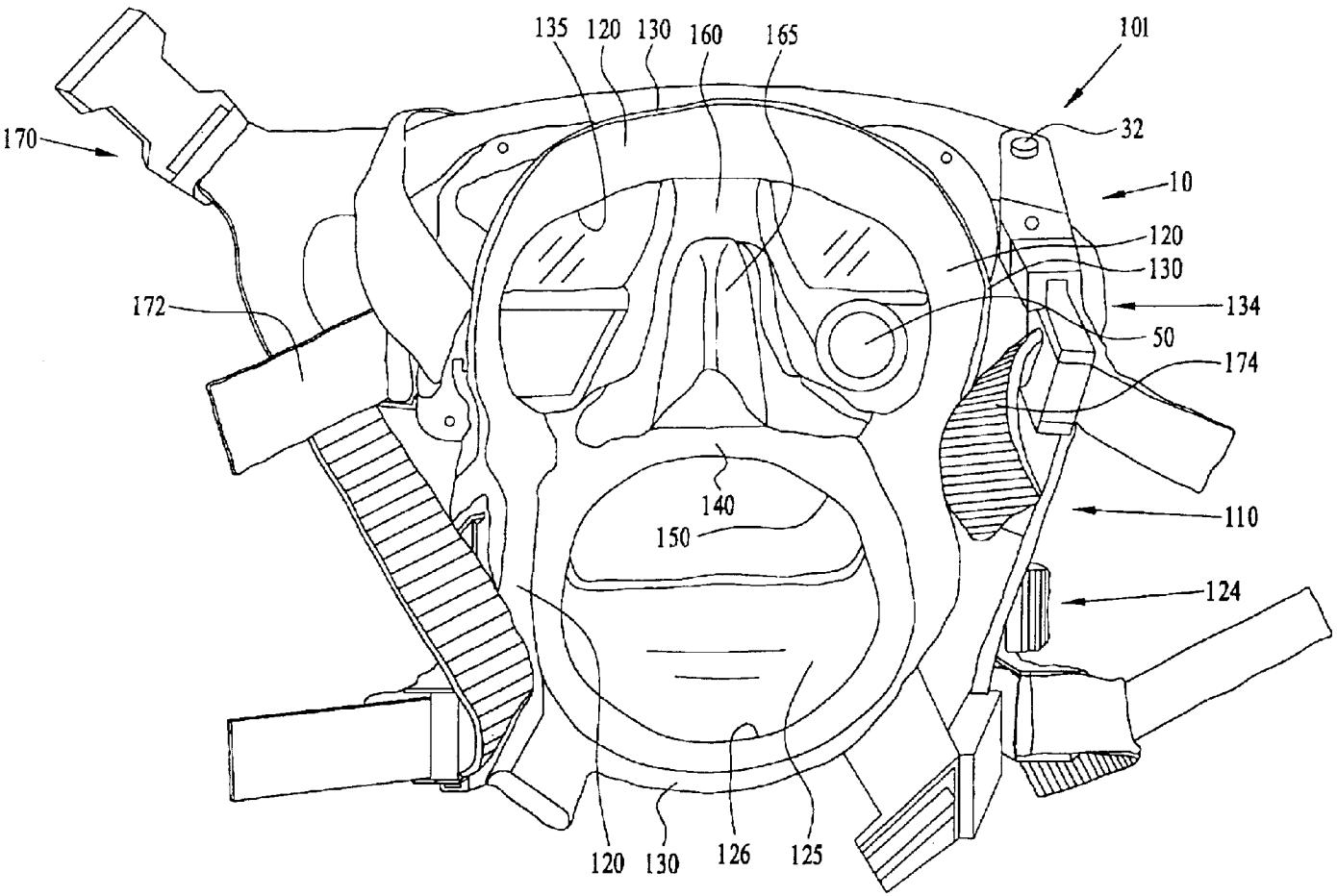
FIG. 2 is a schematic rear view of the improved FFM system of the invention.

Referring to FIGS. 1 and 2, improve full face mask (FFM) system 101 of the invention gives a diver full face coverage for warmth, protection, and comfort and additionally provides an integrated display of multiple-source information. This display of information is in an area of peripheral vision that is outside of the diver's forward field of view 115, 14 that is necessary for performance of tasks.

FFM system 101 has a main body frame 110 that can be made from a flexible neoprene material having sufficient thickness and stiffness to extend in a rugged, continuous, closed sidewall portion 120 having a compliant sidewall elastomeric sealing flange 130 connected to and along said continuous, closed sidewall portion 120 that extends and compliantly rests on the bony contours around the facial features of a wearer of FFM system 101. Continuous sidewall portion 120 and compliant sidewall elastomeric sealing flange 130 extend along areas of bony contours of the face forward of both ears, upward and across the bony contours of the temples, across the top part of the bony contours of the forehead, and downward across the bony contours of the jaw (and teeth) that extend between the chin and the mouth.

Main body frame 110 also has a lateral partition 140 provided with a compliant lateral lip 150 connected to and along lateral partition 140 that extends and rests on the bony contours of the face from one side to another side of sidewall portion 120 and compliant sidewall elastomeric sealing flange 130 of main body frame 110 between the areas of the nose and upper lip of a wearer of FFM system 101. Lateral partition 140, parts of continuous closed sidewall portion 120, and a nose bridge portion 160 at the bridge of the nose of a wearer of FFM system 101 support a flexible nose pocket 165 and a sealed interface for transparent lenses 115. Lenses 115 extend across a forward field of view for a wearer of FFM system 101. An elastic spider 170 has rubber straps 172, 174 connected to main body frame 110 that can be adjusted to snugly pull sidewall portion 120 and compliant sidewall elastomeric sealing flange 130 and lateral partition 140 and compliant lateral lip 150 snugly against the facial features. This snug fitting maintains a sealed interface between FFM system 101 and the facial features of a wearer of FFM system 101.

Lateral partition 140 and compliant lip 150 of main body frame 110 separate the inside of FFM system 101 into a lower mask section 124 having a lower cavity 125 and an upper mask section 134 having an upper cavity 135. Lower mask section 124 has a round, grooved, pod-adapter opening 126 adjacent to lower cavity 125 that encompasses the area of the mouth of a wearer of FFM system 101. Grooved pod-adapter opening 126 allows the inserted attachment of a mating, correspondingly grooved fitting, or pod 127 (schematically shown being separated from pod-adapter opening 126 in FIG. 1) that extends to or accommodates parts of different life support systems 128 such as open-circuit and closed circuit breathing apparatuses 100. Pod-adapter opening 126 can be left open (as shown in FIGS. 1 and 2) without any breathing system attached if the wearer of FFM system 101 is free-diving or swimming with no breathing apparatus other than a snorkel which can extend through it. When needed, pod 127 that is connected to a breathing apparatus 128, 100 can be easily and quickly attached and sealed to or removed from adapter opening 126 of FFM system 101 on the surface or underwater.

Referring also to FIGS. 3 and 4, pod-adapter opening 126 can be coupled to a breathing apparatus 100 such as described with respect to a prior art face mask 10 of the dive mask with integrated monitoring system of U.S. Pat. No. 6,447,115. Breathing apparatus 100 can have an interconnected sensor 22 that senses critical information about breathing apparatus 100. For example, if breathing apparatus 100 included a compressed air tank (or other pressurized gas flask as used in re-breather types of breathing apparatus), sensor 22 can be a pressure sensor. Sensor 22 provides its output to an RF transmitter 24 that transmits an RF signal 26 that can be detected by RF antenna 20 in mask 10. As is known in the art, short range transmission of RF signals through the water is possible. Since dive mask 10 and RF transmitter 24 will be close to one another in essentially fixed relative positions, RF communications will be reliable.

Closed sidewall portion 124 and lateral partition 140 of upper mask section 134 and upper cavity 135 of FFM system 101 incorporate and integrate the integrated wireless, self-contained display components of face mask 10 that can be transmissive or transflective liquid crystal displays, electroluminescent displays or light-emitting diode (LED) displays. Including self-contained integrated display components of face mask 10 in and on closed sidewall portion 124 and lateral partition 140 of upper mask section 134 and upper cavity 135 of FFM system 101 allows the diver-wearer of FFM system 101 to simultaneously monitor information from multiple sources in a single peripheral location at monitor 50 in the lower right corner of upper cavity 135 of upper section 134 of FFM system 101. This simultaneous monitoring in FFM system 10 goes on regardless of environmental conditions and physical constraints upon the diver-wearer and without obstructing the forward field of view. In addition, the diver is able to perform tasks without distraction and consequent greater proficiency because of the ongoing benefits of warmth, comfort and protection across the entire facial area that the full face mask of FFM system 10 provides.

Closed sidewall portion 124 and lateral partition 140 of upper mask section 134 and upper cavity 135 of FFM system 101 incorporates and integrates the self-contained integrated display components of dive mask 10 of U.S. Pat. No. 6,447,115 as schematically shown in FIGS. 3 and 4. RF signals detected by RF antenna 20 are passed through conductors 28 to a pre-programmed controller 30 (e.g., microprocessor) that controls the display of dive information. Selection of various programming options are made by the diver via a single control switch 32 (e.g., a conventional push—push switch). The use of a single user control simplifies use of the present invention as the various functions implemented by control switch 32 are embedded in the programming of controller 30. Control switch 32 is coupled to controller 30 via conductors 34.

While information about the diver's breathing apparatus 100 is critical, it is not the only relevant information that a diver wants to monitor. Specifically, in the illustrated embodiment, controller 30 includes a timer or a software-controlled timer function that can be activated by the diver at the start of a dive to track the amount of time ("bottom time") that a diver is underwater.

In addition to breathing apparatus information and bottom time, a diver needs to monitor his depth in the water. This is accomplished in the present invention, by a depth sensor 36 in frame 12 (and sidewall portion 120 of frame 110 of FFM system 101). Water at depth pressure comes into contact with depth sensor 36 via a port 38 formed in frame 12. The signal indicative of depth generated by depth sensor 36 is passed to controller 30 via conductors 40.

Thus, controller 30 collects or generates signals indicative of the relevant status of breathing apparatus 100, bottom time of the dive, and depth of the diver. These signals are appropriately processed for use by display 50 in a manner well understood in the art. Display signals generated by controller 30 are passed over conductors 42 to directly viewable display 50. The term "directly-viewable" is intended to mean that the diver will view the display itself as opposed to a reflection thereof thereby eliminating display alignment issues.

Display 50 also is integrated in frame 12 (and sidewall portion 120 and lateral portion 140 of frame 110 of FFM system 101) and is completely protected in upper cavity 135 of upper mask section 130 of FFM system 101. Display 50 is located in a peripheral vision area of the diver. Preferably, display 50 is located in a lower portion of the diver's peripheral vision area as illustrated in FIGS. 1, 2, 3, and 4. However, regardless of its position in the diver's peripheral vision area, display 50 is always positioned outside field of view 16 through lens 14 (and lenses 115 of FFM system 101). Thus, the diver will have an unobstructed forward field of view.

Display 50 provides a sufficiently large virtual display image 60 that will be easily discerned by a user's having a wide range of visual acuity and in virtually all lighting conditions. In the illustrated embodiment, display 50 has a liquid crystal display (LCD) element 52 that receives display signals from controller 30. LCD element 52 can be either a transmissive LCD or a transflective LCD, electroluminescent displays, light-emitting diode (LED) displays or other displays. LCD element 52 is back lit by a light source 54 that can be powered via controller 30. An optical system 56 that can be multi-element or three-element lens 56 (or triplet lens as it is known), or a free prism, hybrid prism, curved mirror or fresnel-type lens system is positioned adjacent (i.e., in. front of) LCD element 52 to provide even magnification across it. That is, optical system 56 magnifies all portions of LCD element 52 evenly so that no portion is distorted relative to another portion.

With dive mask 10 (and FFM system 101) configured as described above, virtual image 60 will be directly-viewable by the diver as illustrated in FIG. 4. Virtual image 60 includes a display of diver depth at 62, bottom time of the diver at 64, and pressure of the diver's air/gas tank at 66. While each type of dive information is displayed in a numeric format, the dive information could also be displayed in alternative or additional formats such as a graphical format. Each type of dive information could be flashed on and off (as controlled by controller 30) if they are indicative of dangerous situations.

Power for each component embedded in frame 12 (and sidewall portion 120 and lateral portion 140 of frame 110 of FFM system 101) can be self-contained on each component. More typically, power for each component requiring power can be provided by a replaceable power source such as a battery 70 housed in a compartment 72 formed in frame 12. Compartment 72 is accessible/sealable via a plug 74. Power is transferred to the necessary components via conductors 76 and the other conductors referred to above.

Protection not only provides full face coverage to assure protection, warmth, and comfort during prolonged diving operations in the harsh marine environment, but additionally gives a diver a directly viewable display of critical dive information without obstructing any portion of the diver's field of view through the viewing dive mask lens. The information is reliably brought from well protected components via a single control button and is visible regardless of surrounding water visibility.

Having the teachings of this invention in mind, modifications and alternate embodiments of FFM system 101 may be adapted without departing from the scope of the invention. FFM system 101 could have integrated displays of different inputs from other computers and other navigational systems. However, care must be taken when making such modifications since the bulk of such displays might compromise or otherwise interfere with a diver's forward field of view.

The disclosed components and their arrangements as disclosed herein, all contribute to the novel features of this invention. FFM system 101 of the invention provides for warmth, protection and comfort for extensive diving operations and simultaneously gives a real-time display of pertinent information from multiple sources outside of the forward field of view to enable safe performance of tasks for successful completion of a mission. Therefore, FFM system 101, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

We claim:

1. A full face mask system comprising:

a main body frame having a continuous, closed sidewall portion extending around and compliantly resting on bony contours around facial features of a wearer, and a lateral partition extending along and resting on bony contours of a wearer's face from one side to another side of said sidewall portion between the area of a wearer's nose and the area of a wearer's upper lip, said lateral partition separating said main body frame into a lower mask section having a lower cavity and an upper mask section having an upper cavity, said lower mask section having a round, grooved, pod-adapter opening adjacent to said lower cavity;

at least one lens defining a forward field of view being supported by said frame; and a plurality of components integrated in said frame, said plurality of components including:

a radio frequency (RF) antenna for receiving RF signals indicative of dive information, a display directly viewable in a peripheral vision area outside of said forward field of view, a controller coupled to said RF antenna and said display for processing said RF signals in accordance with predetermined programming options to generate outputs, and an input device coupled to said controller for selecting said predetermined programming options, and passing said outputs to said display for visual display.

2. The full face mask system of claim 1 further comprising:

a compliant sidewall elastomeric sealing flange connected to and along said continuous, closed sidewall portion and extending around and compliantly resting on bony contours around facial features of a wearer of the full face mask system and a compliant lateral lip connected to and along said lateral partition and extending and resting on bony contours of a wearer's face from one side to another side of said sidewall portion between the areas of a wearer's nose and upper lip, said lateral partition and said compliant lateral lip separating said main body frame into said lower mask section having said lower cavity and said upper mask section having said upper cavity.

3. The full face mask system of claim 2 further comprising:

a mating, correspondingly grooved pod being fitted into said pod-adapter opening, said grooved pod extending to a life support system.

4. The full face mask system of claim 3 wherein said display is located in a lower portion of said peripheral vision area.

5. The full face mask system of claim 4 wherein said plurality of components include a replaceable power source for supplying power to all others of said plurality of components and a depth sensor coupled to said controller.

6. The full face mask system of claim 5 wherein said controller includes timing means actuated by said input device, said timing means generating a signal indicative of an amount of time lapsed since actuation of said timing means, said indicative signal being displayed visually on said display.

7. The full face mask system of claim 6 wherein said display includes a stacked combination of a magnifying lens for providing even magnification across said display, a liquid crystal display positioned adjacent said magnifying lens for magnification, and a light source for backlighting said liquid crystal display.

8. The full face mask system of claim 7 wherein said liquid crystal display is selected from the group consisting of a transmissive liquid crystal display and a transflective liquid crystal display.

* * * * *